US009720351B2

(12) United States Patent
Koizumi

(10) Patent No.: US 9,720,351 B2
(45) Date of Patent: Aug. 1, 2017

(54) IMAGE FORMING APPARATUS WITH BELT TRAJECTORY CHANGING MEMBER AND IMAGE FORMING METHOD

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventor: Susumu Koizumi, Shizuoka (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/856,649

(22) Filed: Sep. 17, 2015

(65) Prior Publication Data

US 2017/0082954 A1 Mar. 23, 2017

(51) Int. Cl.
*G03G 15/01* (2006.01)
*G03G 15/16* (2006.01)

(52) U.S. Cl.
CPC ..... *G03G 15/1615* (2013.01); *G03G 15/0136* (2013.01); *G03G 15/0178* (2013.01)

(58) Field of Classification Search
CPC ..... G03G 15/1615; G03G 15/0131; G03G 15/0136; G03G 15/0178; G03G 15/1605; G03G 15/6585; G03G 2215/0119; G03G 2215/0193
USPC ..... 399/299, 302
See application file for complete search history.

(56) References Cited

U.S. PATENT DOCUMENTS 8,175,494 B2 * 5/2012 Kaneyama ..... G03G 15/0136 399/299 X
8,390,859 B2 * 3/2013 Watanabe ..... H04N 1/2307 347/100
2003/0219288 A1 * 11/2003 Hagiwara ..... G03G 15/0136 399/299
2006/0127140 A1 * 6/2006 Miyake ..... G03G 15/0136 399/299
2009/0154970 A1 * 6/2009 Yoshida ..... G03G 15/6588 399/341
2010/0284708 A1 * 11/2010 Sugitani ..... G03G 15/161 399/121
2011/0123235 A1 * 5/2011 Matsuzaki ..... G03G 15/0131 399/301

(Continued)

*Primary Examiner* — Sophia S Chen
(74) *Attorney, Agent, or Firm* — Amin, Turocy & Watson LLP; Gregory Turocy

(57) ABSTRACT

According to one embodiment, an image forming apparatus includes an intermediate transfer belt, multiple first type photoconductive drums, multiple first type transfer rollers, a second type photoconductive drum, a second type transfer roller, a roller, and a roller moving unit. The multiple first type transfer rollers are arranged at positions that face the multiple first type photoconductive drums. The second type photoconductive drum is arranged at a position where the drum surface of the second type photoconductive drum is not tangent to a common tangent plane. The roller is arranged on the inner peripheral side of the intermediate transfer belt and is arranged between the second type transfer roller and one first type transfer roller. The roller moving unit moves the roller by pressing the roller. The roller moving unit changes the state of abutting of the multiple first type photoconductive drums and the second type photoconductive drum.

10 Claims, 6 Drawing Sheets

(56) References Cited

U.S. PATENT DOCUMENTS

| | | | | |
|---|---|---|---|---|
| 2014/0144759 | A1* | 5/2014 | Kawanami | G03G 15/0189 198/813 |
| 2015/0093129 | A1* | 4/2015 | Mitsunobu | G03G 15/50 399/40 |

* cited by examiner

IMAGE FORMING APPARATUS WITH BELT TRAJECTORY CHANGING MEMBER AND IMAGE FORMING METHOD

FIELD

Embodiments described herein relate generally to an image forming apparatus and an image forming method.

BACKGROUND

There is an image forming apparatus that forms a multicolor toner image. The image forming apparatus is arranged with multiple image forming units that form different color toner images on the peripheral portion of an intermediate transfer belt. For example, each image forming unit includes a photoconductive drum. A charger, a light exposure unit, a developing device, a cleaning unit, a static electricity discharger, and the like are arranged around the photoconductive drum.

In most cases, the image forming apparatus includes four color image forming units for yellow, magenta, cyan, and black colors. However, the image forming apparatus may include an image forming unit for fifth color other than yellow, magenta, cyan, and black. For example, the fifth color image forming unit may form a toner image with a gold toner or a silver toner, which may not be reproduced with the four color toners. For example, the fifth color image forming unit may form a toner image with an erasable toner that causes the image to be erasable.

A fifth color image may be an image in the fifth color only. A fifth color image may overlay a full color image formed with the four colors.

The image forming apparatus including five color image forming units has a different frequency of use for each image forming unit. For example, the black image forming unit forms a monochrome image in addition to a full color image. Thus, the frequency of use of the black image forming unit may be high. The frequency of use of the fifth color image forming unit, for example, may be low in comparison with the other four colors.

In most cases, the photoconductive drum of an image forming unit having a low frequency of use is brought into contact with the intermediate transfer belt without a toner therebetween. Thus, the photoconductive drum is likely to be degraded.

Separating the photoconductive drum from the intermediate transfer belt is also considered when images are not formed. However, a problem arises in that a complicated mechanism is required to separate each photoconductive drum from the intermediate transfer belt individually.

DETAILED DESCRIPTION

In general, according to one embodiment, an image forming apparatus includes an intermediate transfer belt, multiple first type photoconductive drums, and multiple first type transfer rollers. The image forming apparatus further includes a second type photoconductive drum, a second type transfer roller, a roller, and a roller moving unit. The intermediate transfer belt rotates and carries a toner image that is to be primarily transferred. The toner image on the intermediate transfer belt is secondarily transferred onto a sheet at a secondary transfer position. The multiple first type photoconductive drums are arranged to have a common tangent plane to drum surfaces on the outer peripheral side of the intermediate transfer belt. The multiple first type transfer rollers are arranged at positions that face the multiple first type photoconductive drums on the inner peripheral side of the intermediate transfer belt. The multiple first type transfer rollers transfer toner images that are formed on the multiple first type photoconductive drums onto the intermediate transfer belt. The second type photoconductive drum is arranged on the outer peripheral side of the intermediate transfer belt. The second type photoconductive drum is arranged at a position that is farther separated from the secondary transfer position than the multiple first type photoconductive drums and at a position where the drum surface of the second type photoconductive drum is not tangent to the common tangent plane from the same direction as the multiple first type photoconductive drums. The second type transfer roller is arranged on the inner peripheral side of the intermediate transfer belt. The second type transfer roller is arranged at a position that faces the second type photoconductive drum. The second type transfer roller transfers a toner image that is formed on the second type photoconductive drum onto the intermediate transfer belt. The roller is arranged on the inner peripheral side of the intermediate transfer belt. The roller is arranged between the second type transfer roller and one transfer roller of the multiple first type transfer rollers that is the closest to the second type transfer roller. The roller moving unit presses and moves the roller to the inner peripheral face of the intermediate transfer belt. The roller moving unit changes the state of abutting of the multiple first type photoconductive drums and the second type photoconductive drum on the intermediate transfer belt.

Embodiment

Hereinafter, an image forming apparatus 100 of an embodiment will be described with reference to drawings. In each drawing, the same configuration is given the same reference sign unless otherwise specified.

Figure 1:
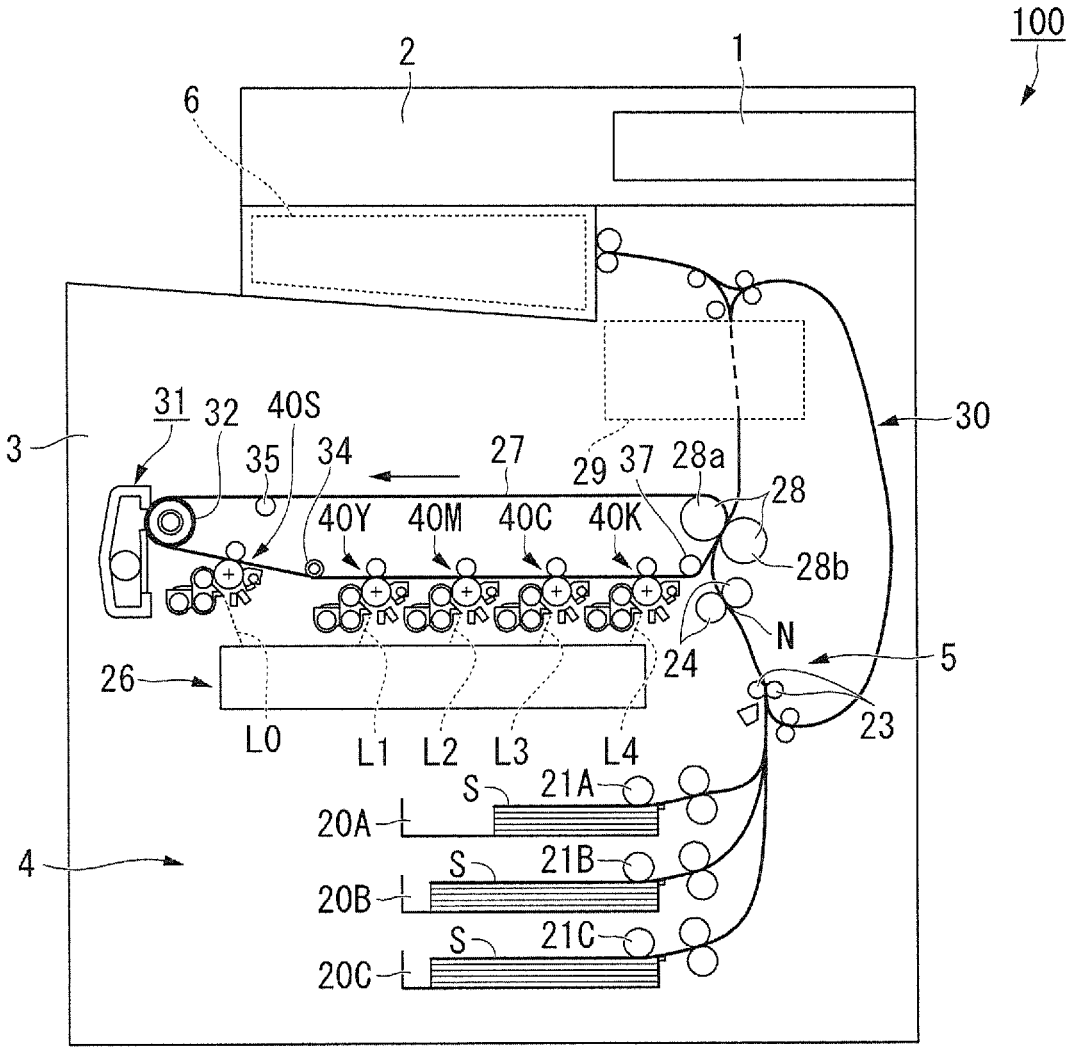
FIG. 1 is a schematic sectional view illustrating an example of the entire configuration of an image forming apparatus in an embodiment.
Figure 2:
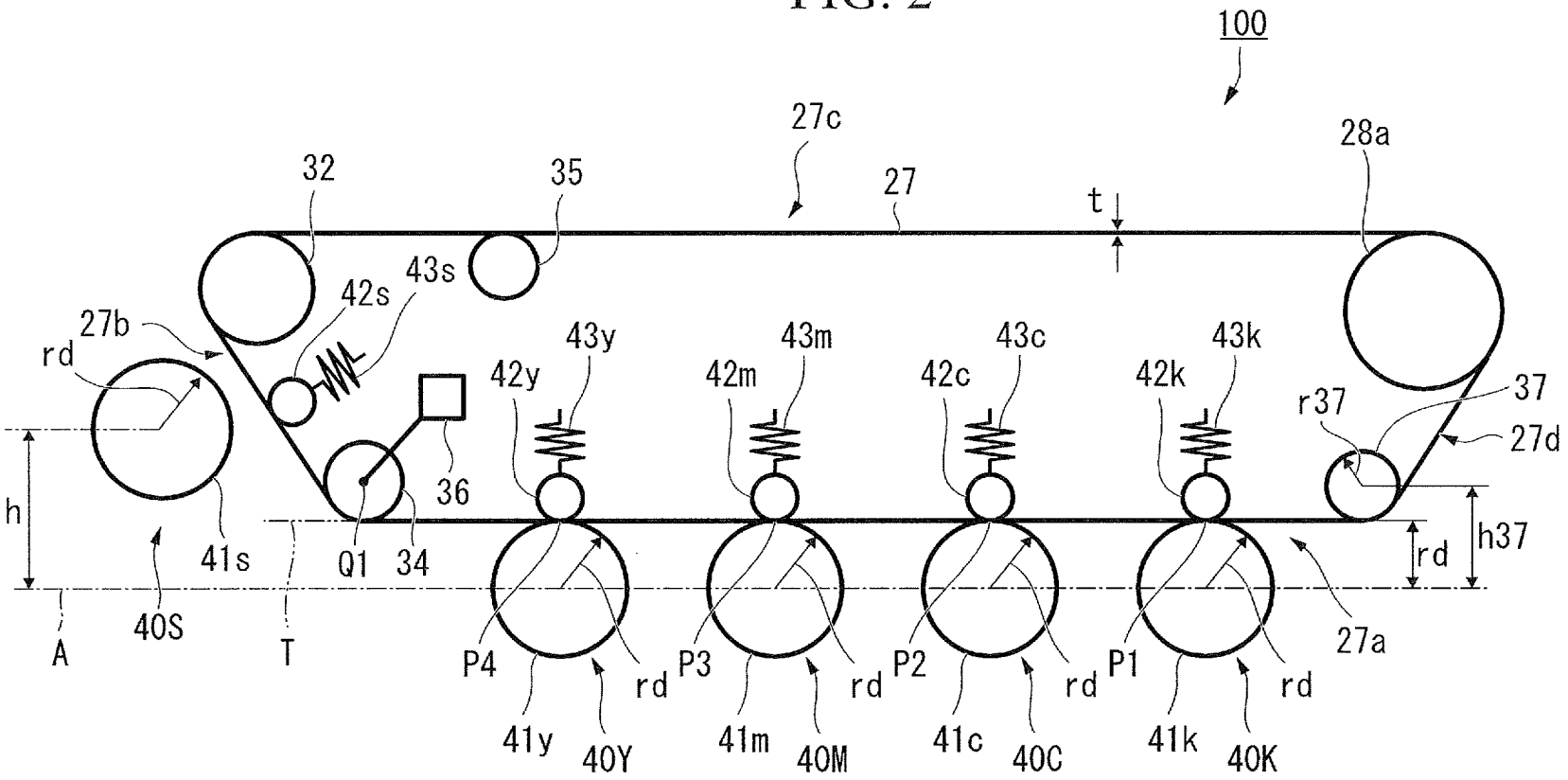
FIG. 2 is a schematic sectional view illustrating a configuration example of main portions of the image forming apparatus in the embodiment.
Figure 3:
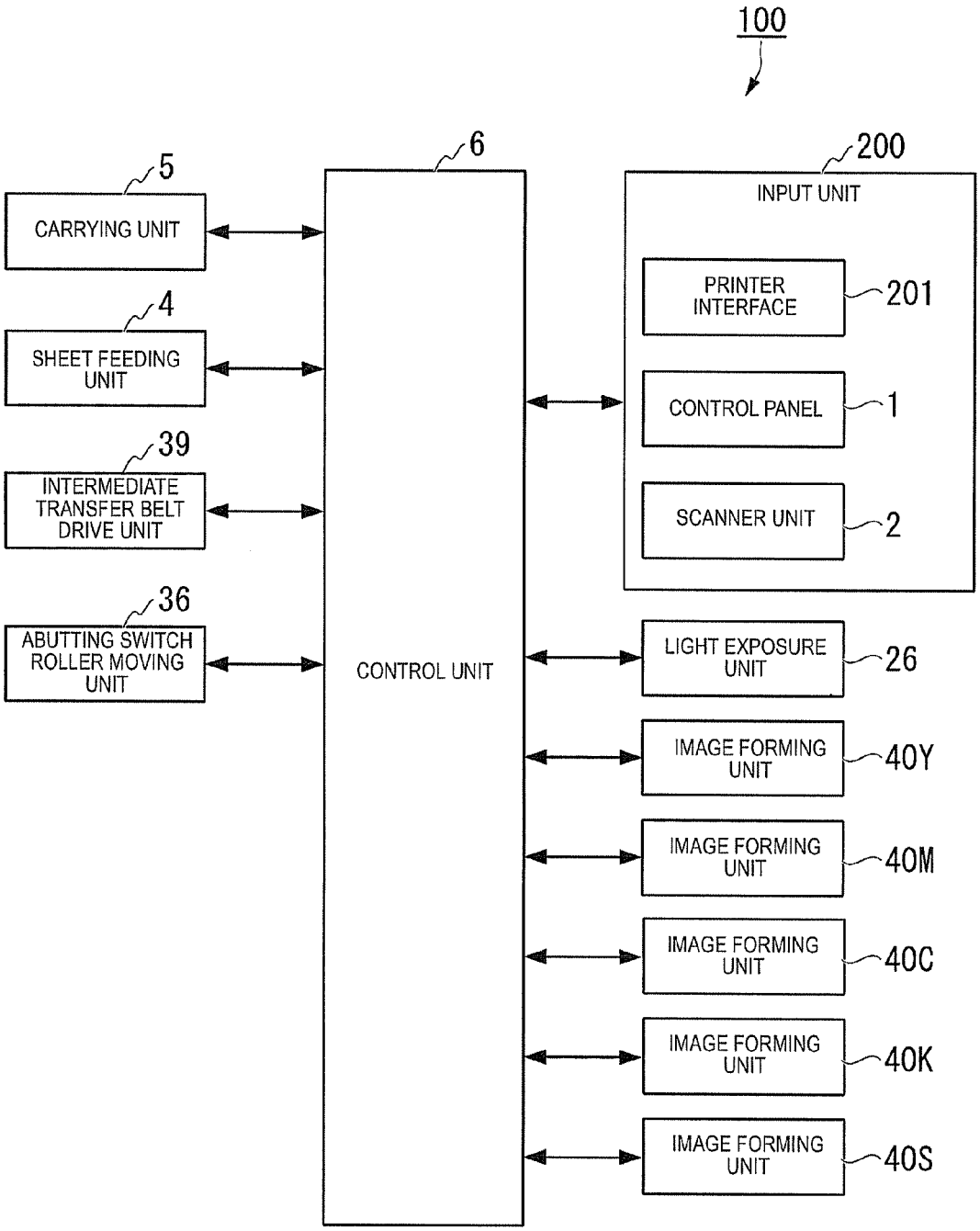
FIG. 3 is a block diagram illustrating a functional configuration example of the image forming apparatus in the embodiment.
Figure 4:
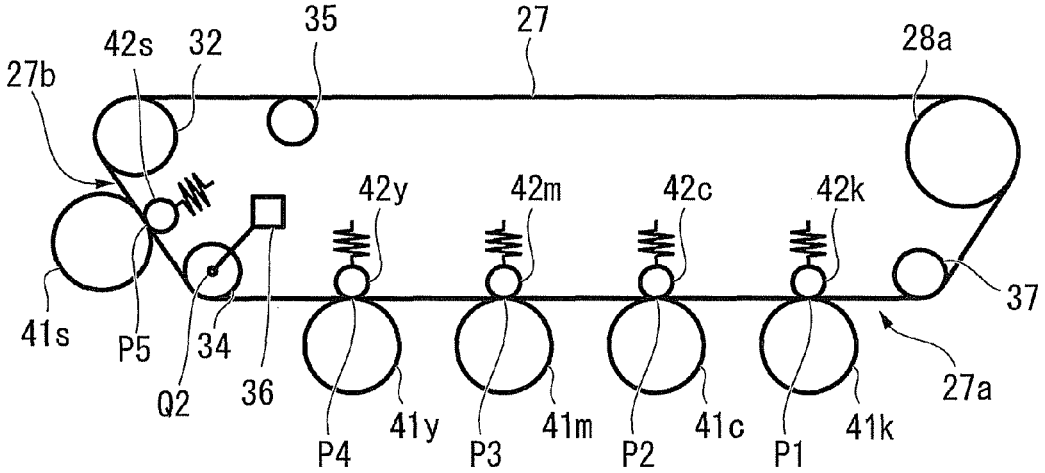
FIG. 4 is a schematic sectional view illustrating a second state of abutting in the image forming apparatus of the embodiment.
Figure 5:
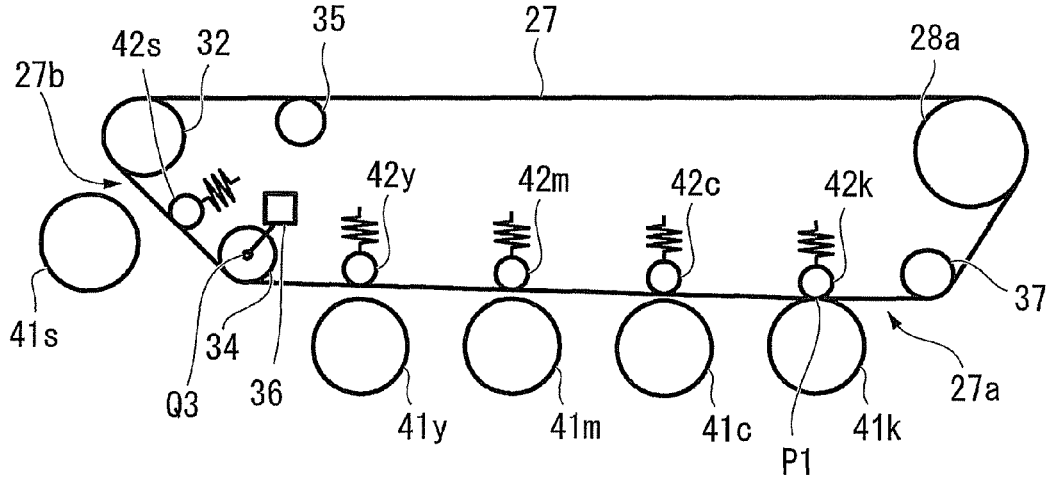
FIG. 5 is a schematic sectional view illustrating a third state of abutting in the image forming apparatus of the embodiment.
Figure 6:
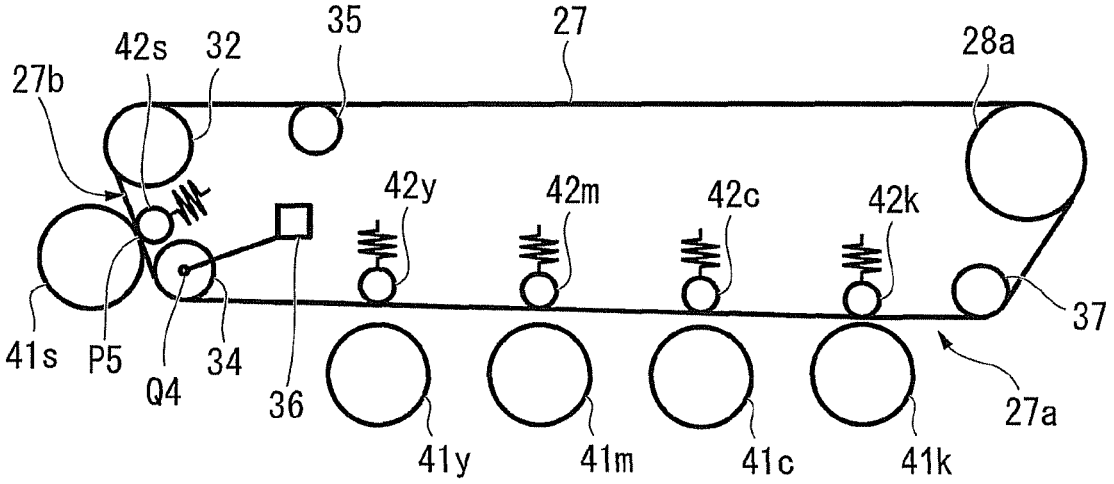
FIG. 6 is a schematic sectional view illustrating a fourth state of abutting in the image forming apparatus of the embodiment.

FIG. 1 is a schematic sectional view illustrating an example of the entire configuration of the image forming apparatus 100 in the embodiment. FIG. 2 is a schematic sectional view illustrating a configuration example of main portions of the image forming apparatus 100 in the embodiment. FIG. 3 is a block diagram illustrating a functional configuration example of the image forming apparatus 100 in the embodiment. FIG. 4 is a schematic sectional view illustrating a second abutted state in the image forming apparatus 100 of the embodiment. FIG. 5 is a schematic sectional view illustrating a third abutted state in the image forming apparatus 100 of the embodiment. FIG. 6 is a schematic sectional view illustrating a fourth abutted state in the image forming apparatus 100 of the embodiment.

The image forming apparatus 100 of the embodiment, as illustrated in FIG. 1, includes a control panel 1, a scanner unit 2, a printer unit 3, a sheet feeding unit 4, a carrying unit 5, and a control unit 6.

The control panel 1 is a part of an input unit on which an operator inputs information so as to operate the image forming apparatus 100. The control panel 1 includes a touch panel and various hard keys. The control panel 1 includes a start key that initiates image formation.

The scanner unit 2 reads image information about a subject as brightness and darkness of light. The scanner unit 2 outputs the read image information to the printer unit 3.

The printer unit 3 forms an output image (hereinafter, referred to as a toner image) with a developer that includes toner and the like on the basis of the image information read by the scanner unit 2 or an image signal from the outside.

The printer unit 3 transfers the toner image onto the surface of a sheet S (paper). The printer unit 3 fixes the toner image to the sheet S by applying heat and pressure to the toner image on the surface of the sheet S.

The sheet feeding unit 4 feeds the sheet S one by one to the printer unit 3 according to the timing of the printer unit 3 forming the toner image.

The sheet feeding unit 4 includes multiple paper feeding cassettes 20A, 20B, and 20C. Each of the paper feeding cassettes 20A, 20B, and 20C accommodates the sheet S having a preset size and a preset type. The paper feeding cassettes 20A, 20B, and 20C respectively include pick-up rollers 21A, 21B, and 21C. Each of the pick-up rollers 21A, 21B, and 21C withdraws one sheet S from each of the paper feeding cassettes 20A, 20B, and 20C. The pick-up rollers 21A, 21B, and 21C feed the withdrawn sheet S to the carrying unit 5.

The carrying unit 5 includes a carrying roller 23 and a resist roller 24. The carrying unit 5 carries the sheet S fed by the pick-up rollers 21A, 21B, and 21C to the resist roller 24. The resist roller 24 carries the sheet S according to the timing of the printer unit 3 transferring the toner image onto the sheet S.

By the carrying roller 23, the tip end of the sheet S in the direction of carrying abuts a nip N of the resist roller 24. The carrying roller 23 aligns the tip end of the sheet S in the direction of carrying by bending the sheet S.

The resist roller 24 aligns the tip end of the sheet S to the nip N. Furthermore, the resist roller 24 carries the sheet S toward a later-described transfer unit 28.

Next, a detailed configuration of the printer unit 3 will be described.

The printer unit 3 includes image forming units 40K, 40C, 40M, 40Y, and 40S, a light exposure unit 26, an intermediate transfer belt 27, the transfer unit 28, a fixer 29, and a transfer belt cleaning unit 31.

Each of the image forming units 40K, 40C, 40M, 40Y, and 40S forms the toner image according to the image signal from the scanner unit 2 or the outside.

The image forming units 40K, 40C, 40M, 40Y, and 40S, as illustrated in FIG. 2, respectively include photoconductive drums 41*k*, 41*c*, 41*m*, 41*y*, and 41*s*. The photoconductive drums 41*k*, 41*c*, 41*m*, 41*y*, and 41*s* in this order are first, second, third, fourth, and fifth photoconductive drums.

The image forming units 40K, 40C, 40M, and 40Y respectively form toner images with black, cyan, magenta, and yellow toners on the photoconductive drums 41*k*, 41*c*, 41*m*, and 41*y*. Black, cyan, magenta, and yellow in this order are a first color, a second color, a third color, and a fourth color.

The image forming unit 40S forms a toner image with a fifth color toner on the photoconductive drum 41*s*. Examples of the fifth color toner may include a gold toner and a silver toner. Metallic colors such as gold and silver include photoluminescent pigments so as to give a metallic luster that characterizes metallic colors.

Examples of the fifth color toner may include an erasable toner. The erasable toner can be decolorized after the toner image is transferred and fixed to the sheet S. A method for decolorizing the erasable toner is not limited. For example, the erasable toner may be an erasable toner that is decolorized by heat. For example, the erasable toner may be an erasable toner that is decolorized by chemical agents.

As an example, the fifth color toner will be described as a gold toner below. The "five colors" mean black, cyan, magenta, yellow, and gold below unless otherwise specified. The "four colors" mean black, cyan, magenta, and yellow.

The photoconductive drums 41*s*, 41*y*, 41*m*, 41*c*, and 41*k* are arranged parallel to each other at intervals as illustrated in FIG. 2. The photoconductive drums 41*s*, 41*y*, 41*m*. 41*c* and 41*k* are lined up in this order. The axial direction of each of the photoconductive drums 41*s*, 41*y*, 41*m*, 41*c*, and 41*k* is orthogonal with respect to the direction of rotation of the later-described intermediate transfer belt 27. The photoconductive drums 41*s*, 41*y*, 41*m*, 41*c*, and 41*k* have the same drum radius rd.

The photoconductive drums 41*y*, 41*m*, 41*c*, and 41*k* are positioned to have a common tangent plane T to the drum surfaces. Each of the photoconductive drums 41*y*, 41*m*, 41*c*, and 41*k* is a first type photoconductive drum.

Meanwhile, the photoconductive drum 41*s* is arranged at a position to which the common tangent plane T of the photoconductive drums 41*y*, 41*m*, 41*c*, and 41*k* is not tangent in the same direction as the photoconductive drums 41*y*, 41*m*, 41*c*, and 41*k*. The position to which the tangent plane T is not tangent in the same direction includes a position to which the common tangent plane T is not tangent and a position to which the common tangent plane T is tangent in the opposite direction.

The photoconductive drum 41*s* is a second type photoconductive drum.

In the present embodiment, all of the rotational axis lines of the photoconductive drums 41*y*, 41*m*, 41*c*, and 41*k* are positioned a distance rd from the common tangent plane T downward in FIG. 2. The rotational axis lines of the photoconductive drums 41*y*, 41*m*, 41*c*, and 41*k* are positioned on one plane. This plane will be referred to as a plane A. The rotational axis line of the photoconductive drum 41*s* is separated by a distance h (where h>0) from the plane A. In the case of h=2×rd, the common tangent plane T of the photoconductive drums 41*y*, 41*m*, 41*c*, and 41*k* is tangent to the photoconductive drum 41*s*. In this case, the tangent plane T is tangent to the photoconductive drum 41*s* in the opposite direction from the photoconductive drums 41*y*, 41*m*, 41*c*, and 41*k*. Therefore, h=2×rd may be allowed.

Although not illustrated in FIG. 2, known types of a charger, a developing device, a cleaning unit, and a static electricity discharger are arranged around each of the photoconductive drums 41*s*, 41*y*, 41*m*, 41*c*, and 41*k*.

The chargers of the image forming units 40S, 40Y, 40M, 40C, and 40K respectively charge the surfaces of the photoconductive drums 41*s*, 41*y*, 41*m*, 41*c*, and 41*k*.

The developing devices of the image forming units 40S, 40Y, 40M, 40C, and 40K respectively accommodate developers including gold, yellow, magenta, cyan, and black toners. Each developing device develops electrostatic latent images on the photoconductive drums 41*s*, 41*y*, 41*m*, 41*c*, and 41*k*. As a result, toner images are formed with each color toner on the photoconductive drums 41*s*, 41*y*, 41*m*, 41*c*, and 41*k*.

Primary transfer rollers 42*s*, 42*y*, 42*m*, 42*c*, and 42*k* face the photoconductive drums 41*s*, 41*y*, 41*m*, 41*c*, and 41*k*. The later-described intermediate transfer belt 27 is interposed between the primary transfer rollers 42*s*, 42*y*, 42*m*, 42*c*, and 42*k* and the photoconductive drums 41*s*, 41*y*, 41*m*, 41*c*, and 41*k*.

The primary transfer rollers 42*s*, 42*y*, 42*m*, 42*c*, and 42*k* are arranged on the inner peripheral side of the later-described intermediate transfer belt 27.

The photoconductive drums 41*s*, 41*y*, 41*m*, 41*c*, and 41*k* are arranged on the outer peripheral side of the later-described intermediate transfer belt 27.

A transfer bias is applied to the primary transfer rollers 42*s*, 42*y*, 42*m*, 42*c*, and 42*k* by the later-described control unit 6. The primary transfer rollers 42*s*, 42*y*, 42*m*, 42*c*, and 42*k* primarily transfer the respective toner images formed by the image forming units 40S, 40Y, 40M, 40C, and 40K onto the intermediate transfer belt 27.

The primary transfer rollers 42*k*, 42*c*, 42*m*, 42*y*, and 42*s* in this order are first, second, third, fourth, and fifth transfer rollers. The primary transfer rollers 42*y*, 42*m*, 42*c*, and 42*k* are first type transfer rollers. The primary transfer roller 42*s* is a second type transfer roller.

Each cleaning unit of the image forming units 40S, 40Y, 40M, 40C, and 40K removes non-transferred toner on the surface of each photoconductive drum by scraping or the like after the primary transfer.

Each static electricity discharger of the image forming units 40S, 40Y, 40M, 40C, and 40K irradiates the surface of the photoconductive drum that passes through the cleaning unit with light. Each static electricity discharger discharges the photoconductive drums 41*s*, 41*y*, 41*m*, 41*c*, and 41*k*.

The later-described light exposure unit 26 is positioned below the chargers and the developing devices as illustrated in FIG. 1.

The light exposure unit 26 irradiates the surfaces of the photoconductive drums 41*s*, 41*y*, 41*m*, 41*c*, and 41*k* with exposure light rays L0, L1, L2, L3, and L4. The exposure light rays L0, L1, L2, L3, and L4 are modulated on the basis of the image signal transmitted from the scanner unit 2 or the outside. The image signal transmitted from the scanner unit 2 or the outside to the light exposure unit 26 corresponds to an image formed on the sheet S.

The light exposure unit 26 forms electrostatic latent images on the photoconductive drums 41*s*, 41*y*, 41*m*, 41*c*, and 41*k* according to the image signal. The position of irradiation of each exposure light ray is between the charger and the developing device in each photoconductive drum.

A configuration of scanning a laser beam can be used as an example of the light exposure unit 26. A configuration of performing a solid-state scan by using an LED light-emitting element can also be used as an example of the light exposure unit 26.

The intermediate transfer belt 27 is configured of an endless belt as illustrated in FIG. 1. Multiple rollers abut the inner peripheral face of the intermediate transfer belt 27. The multiple rollers apply a tensile force to the intermediate transfer belt 27. The multiple rollers tension the intermediate transfer belt 27 flat.

The intermediate transfer belt 27 is positioned above the photoconductive drums 41*s*, 41*y*, 41*m*, 41*c*, and 41*k*. The intermediate transfer belt 27 is tensioned along the direction of the photoconductive drums 41*s*, 41*y*, 41*m*, 41*c*, and 41*k* being lined up.

A support roller 28*a* abuts the photoconductive drum 41*k* side end portion of the inner peripheral face of the intermediate transfer belt 27 in the direction of tension. A transfer belt roller 32 (second fixed roller) abuts the photoconductive drum 41*s* side end portion of the inner peripheral face of the intermediate transfer belt 27 in the direction of tension.

The positions of the support roller 28*a* and the transfer belt roller 32 are fixed with respect to the intermediate transfer belt 27.

The support roller 28*a* constitutes a part of the later-described transfer unit 28. The support roller 28*a* guides the intermediate transfer belt 27 to a later-described secondary transfer position.

The transfer belt roller 32 guides the intermediate transfer belt 27 to a cleaning position.

The support roller 28*a* and the transfer belt roller 32 are connected to an intermediate transfer belt drive unit 39 (refer to FIG. 3).

The intermediate transfer belt drive unit 39 rotates the support roller 28*a* and the transfer belt roller 32 counter-clockwise in FIG. 1. The intermediate transfer belt drive unit 39 is controlled by the later-described control unit 6.

Other rollers that tension the intermediate transfer belt 27 are a passive roller 37 (first fixed roller), an abutting switch roller 34 (roller), and a tension roller 35 as illustrated in FIG. 2.

The passive roller 37 and the abutting switch roller 34 abut the inner peripheral face of the intermediate transfer belt 27 on the lower side between the support roller 28*a* and the transfer belt roller 32. The passive roller 37 is positioned between the photoconductive drum 41*k* and the support roller 28*a* along the intermediate transfer belt 27. The abutting switch roller 34 is positioned between the photoconductive drums 41*s* and 41*y* along the intermediate transfer belt 27.

The height of the rotational axis line of the passive roller 37 from the plane A is h37. The height h37 has dimensions that allow the intermediate transfer belt 27 abutting the passive roller 37 to be arranged at a position separated by the distance rd from the plane A. Given that the radius of the passive roller 37 is r37, and the thickness of the intermediate transfer belt 27 is t, for example, h37=rd+r37+t can be established.

The position of the passive roller 37 is fixed with respect to the intermediate transfer belt 27.

The part of the intermediate transfer belt 27 being tensioned between the support roller 28*a* and the passive roller 37 will be referred to as a first tensioned area 27*d*. The first tensioned area 27*d* is inclined in a certain direction.

The abutting switch roller 34 is movably supported by an abutting switch roller moving unit 36 (roller moving unit).

The abutting switch roller moving unit 36 moves the abutting switch roller 34. The abutting switch roller moving unit 36 changes the position of pressing the abutting switch roller 34 to the inner peripheral face of the intermediate transfer belt 27. When the position of pressing the abutting switch roller 34 is changed, the tensioned shape of the intermediate transfer belt 27 is changed.

The part of the intermediate transfer belt 27 being tensioned between the passive roller 37 and the abutting switch roller 34 will be referred to as a second tensioned area 27*a* below. The part of the intermediate transfer belt 27 being tensioned between the passive roller 37 and the transfer belt roller 32 will be referred to as a third tensioned area 27*b*. The part of the intermediate transfer belt 27 being tensioned between the transfer belt roller 32 and the support roller 28*a* will be referred to as a fourth tensioned area 27*c*.

The state of abutting between the intermediate transfer belt 27 and the photoconductive drums 41*s*, 41*y*, 41*m*, 41*c*, and 41*k* is changed when the position of pressing the abutting switch roller 34 is changed.

For example, a configuration of the abutting switch roller moving unit 36 includes a motor that is a drive source, a gear that transmits the driving force of the motor, and a cam that interlocks with the gear. The cam moves the position of the abutting switch roller 34 to a predetermined position.

Hereinafter, the state of abutting between the intermediate transfer belt 27 and the photoconductive drums 41*s*, 41*y*, 41*m*, 41*c*, and 41*k* may be shortly referred to as a "belt abutting state".

The abutting switch roller moving unit 36 in the embodiment selectively switches the belt abutting state among first, second, third, and fourth states of abutting.

The first state of abutting is a belt abutting state in which all of the multiple first type photoconductive drums abut the intermediate transfer belt, and the second type photoconductive drum is separated from the intermediate transfer belt.

In the first state of abutting, as illustrated in FIG. 2, the photoconductive drums 41*y*, 41*m*, 41*c*, and 41*k* abut the intermediate transfer belt 27 in the second tensioned area 27*a* (refer to positions P4, P3, P2, and P1). Furthermore, in the first state of abutting, the third tensioned area 27*b* facing the photoconductive drum 41*s* is separated from the photoconductive drum 41*s*. Thus, the photoconductive drum 41*s* is separated from the intermediate transfer belt 27.

Since FIG. 2 is schematically illustrated, the second tensioned area 27*a* in the first state of abutting is tensioned as a plane conforming to the tangent plane T of the photoconductive drums 41*y*, 41*m*, 41*c*, and 41*k*. However, the second tensioned area 27*a* is not necessarily a plane when the intermediate transfer belt 27 is pressed to each photoconductive drum by the primary transfer rollers 42*y*, 42*m*, 42*c*, and 42*k*. The passive roller 37 and the abutting switch roller 34 may be arranged at positions that cause the intermediate transfer belt 27 in the vicinity of the passive roller 37 and the abutting switch roller 34 to be shifted from the tangent plane T. This is applied in the same manner to the later-described second state of abutting.

The second state of abutting is a belt abutting state in which all of the multiple first type photoconductive drums and the second type photoconductive drum abut the intermediate transfer belt.

In the second state of abutting, as illustrated in FIG. 4, the photoconductive drums 41*y*, 41*m*, 41*c*, and 41*k* abut the intermediate transfer belt 27 in the second tensioned area 27*a* (refer to the positions P4, P3, P2, and P1). Furthermore, in the second state of abutting, the photoconductive drum 41*s* abuts the intermediate transfer belt 27 in the third tensioned area 27*b* (refer to a position P5).

The third state of abutting is a belt abutting state in which only the first type photoconductive drum that is closest to the secondary transfer position among the multiple first type photoconductive drums abuts the intermediate transfer belt, and the other first type photoconductive drums among the multiple first type photoconductive drums and the second type photoconductive drum are separated from the intermediate transfer belt.

In the third state of abutting, as illustrated in FIG. 5, the photoconductive drum 41*k* abuts the intermediate transfer belt 27 in the second tensioned area 27*a* (refer to the position P1). Furthermore, in the third state of abutting, the photoconductive drums 41*y*, 41*m*, 41*c*, and 41*s* are separated from the intermediate transfer belt 27.

The fourth state of abutting is a belt abutting state in which the second type photoconductive drum abuts the intermediate transfer belt, and all of the multiple first type photoconductive drums are separated from the intermediate transfer belt.

In the fourth state of abutting, as illustrated in FIG. 6, the photoconductive drums 41*y*, 41*m*, 41*c*, and 41*k* are separated from the intermediate transfer belt 27. Furthermore, in the fourth state of abutting, the photoconductive drum 41*s* abuts the intermediate transfer belt 27 in the third tensioned area 27*b* (refer to the position P5).

There are four types of the positions of pressing the abutting switch roller 34 in the image forming apparatus 100. The four types of the pressing positions change a belt abutting state to the above first, the second, the third, and the fourth states of abutting. A relationship between the position of pressing the abutting switch roller 34 and a belt abutting state will be described later in an operational description.

The tension roller 35 abuts the inner peripheral face of the intermediate transfer belt 27 in the fourth tensioned area 27*c* as illustrated in FIG. 2. The tension roller 35 presses the intermediate transfer belt 27 outward. The tension roller 35 constantly maintains the tensile force of the intermediate transfer belt 27 even when the abutting switch roller 34 moves.

For example, the tension roller 35 is caused to elastically press the intermediate transfer belt 27 by an unillustrated pressure-applying spring.

The primary transfer roller 42*s* is positioned between the transfer belt roller 32 and the abutting switch roller 34 inside the intermediate transfer belt 27. The primary transfer roller 42*s* faces the photoconductive drum 41*s* as described above. The primary transfer roller 42*s* is supported by a transfer roller pressing unit 43*s*.

The transfer roller pressing unit 43*s* causes the primary transfer roller 42*s* to abut the inner peripheral face of the third tensioned area 27*b*. When the tensioned shape of the intermediate transfer belt 27 is changed by a movement of the abutting switch roller 34, the transfer roller pressing unit 43*s* follows a change in the third tensioned area 27*b*.

The primary transfer rollers 42*y*, 42*m*, 42*c*, and 42*k* are positioned between the abutting switch roller 34 and the passive roller 37 inside the intermediate transfer belt 27. The primary transfer rollers 42*y*, 42*m*, 42*c*, and 42*k* face the photoconductive drums 41*y*, 41*m*, 41*c*, and 41*k* as described above. The primary transfer rollers 42*y*, 42*m*, 42*c*, and 42*k* are respectively supported by transfer roller pressing units 43*y*, 43*m*, 43*c*, and 43*k*.

The transfer roller pressing units 43*y*, 43*m*, 43*c*, and 43*k* respectively cause the primary transfer rollers 42*y*, 42*m*, 42*c*, and 42*k* to abut the inner peripheral face of the second tensioned area 27*a*. When the tensioned shape of the intermediate transfer belt 27 is changed by a movement of the abutting switch roller 34, the transfer roller pressing units 43*y*, 43*m*, 43*c*, and 43*k* follow a change in the second tensioned area 27*a*.

The transfer unit 28 is positioned at a position adjacent to the image forming unit 40K on the intermediate transfer belt 27.

The transfer unit 28 includes the above support roller 28*a* and a secondary transfer roller 28*b*. The intermediate transfer belt 27 is interposed between the support roller 28*a* and the secondary transfer roller 28*b*. The position where the secondary transfer roller 28*b* and the intermediate transfer belt 27 abut each other is the secondary transfer position.

The photoconductive drum 41*k* is the closest to the secondary transfer position among the first type photoconductive drums. The photoconductive drum 41*y* is the furthest from the secondary transfer position among the first type photoconductive drums.

The photoconductive drum 41*s* which is the second type photoconductive drum is farther separated from the secondary transfer position than any other first type photoconductive drums.

The transfer unit 28 transfers the toner image, which is primarily transferred onto the intermediate transfer belt 27, onto the surface of the sheet S at the secondary transfer position. The transfer unit 28 applies a transfer bias to the secondary transfer position. The transfer unit 28 transfers the toner image on the intermediate transfer belt 27 onto the sheet S with the transfer bias.

The fixer 29 applies heat and pressure to the sheet S. The fixer 29 fixes the toner image transferred onto the sheet S with heat and pressure.

The transfer belt cleaning unit 31 faces the transfer belt roller 32. The intermediate transfer belt 27 is interposed in the transfer belt cleaning unit 31. The transfer belt cleaning unit 31 scrapes toner on the surface of the intermediate transfer belt 27. The transfer belt cleaning unit 31 collects the scraped toner in a waste toner tank.

The printer unit 3 further includes an inverting unit 30. The inverting unit 30 inverts the sheet S discharged from the fixer 29 with a switchback. The inverting unit 30 carries the inverted sheet S back into a carrying guide in front of the resist roller 24. The inverting unit 30 inverts the sheet S so that an image can be formed on the rear side of the sheet S.

The control unit 6, as illustrated in FIG. 3, is communicably connected with an input unit 200, the light exposure unit 26, the image forming units 40Y, 40M, 40C, 40K, and 40S, the carrying unit 5, the sheet feeding unit 4, the intermediate transfer belt drive unit 39, and the abutting switch roller moving unit 36. The control unit 6 controls an image forming operation on the basis of an instruction that is input from the input unit 200. Furthermore, the control unit 6 controls switching of the belt abutting state.

The input unit 200 includes a printer interface 201 and the above control panel 1 and the scanner unit 2.

The printer interface 201 is an interface that is used when the image forming apparatus 100 is used as a printer. The printer interface 201 is connected to a communication line.

A control value that is used in the control of the control unit 6 is stored in advance on a storage unit of the control unit 6. The control value used in the control of the control unit 6 is input from the control panel 1 when necessary.

The control unit 6 performs control depending on an operational mode of the image forming apparatus 100.

The image forming apparatus 100 includes at least a four-color mode, a five-color mode, a first color mode, and a fifth color mode as the operational mode.

The four-color mode is an operational mode in which the image forming apparatus 100 forms an image that includes a toner image in at least one color of yellow, magenta, cyan, and black toners. The belt abutting state is the first state of abutting in the four-color mode.

The five-color mode is an operational mode in which the image forming apparatus 100 forms an image that includes a toner image in at least one color of yellow, magenta, cyan, black, and gold toners. The belt abutting state is the second state of abutting in the five-color mode.

The first color mode is an operational mode in which the image forming apparatus 100 forms an image with a toner image only in black which is the first color. The belt abutting state is the third state of abutting in the first color mode.

The fifth color mode is an operational mode in which the image forming apparatus 100 forms an image with a toner image only in gold which is the fifth color. The belt abutting state is the fourth state of abutting in the fifth color mode.

Details of the control of the control unit 6 will be described later along with the operation of the image forming apparatus 100.

An apparatus configuration of the control unit 6 is configured of appropriate pieces of hardware and a computer that includes a CPU, a memory, an input-output interface, an external storage device, and the like. The memory and the external storage device constitute the storage unit of the control unit 6. The above control function of the control unit 6 is realized by a computer executing a control program. Alternatively, the above control function of the control unit 6 is realized by the operation of the appropriate pieces of hardware.

The operation of the image forming apparatus 100 that includes the above configuration will be described with a main focus on an operation of switching the belt abutting state.

Figure 7:
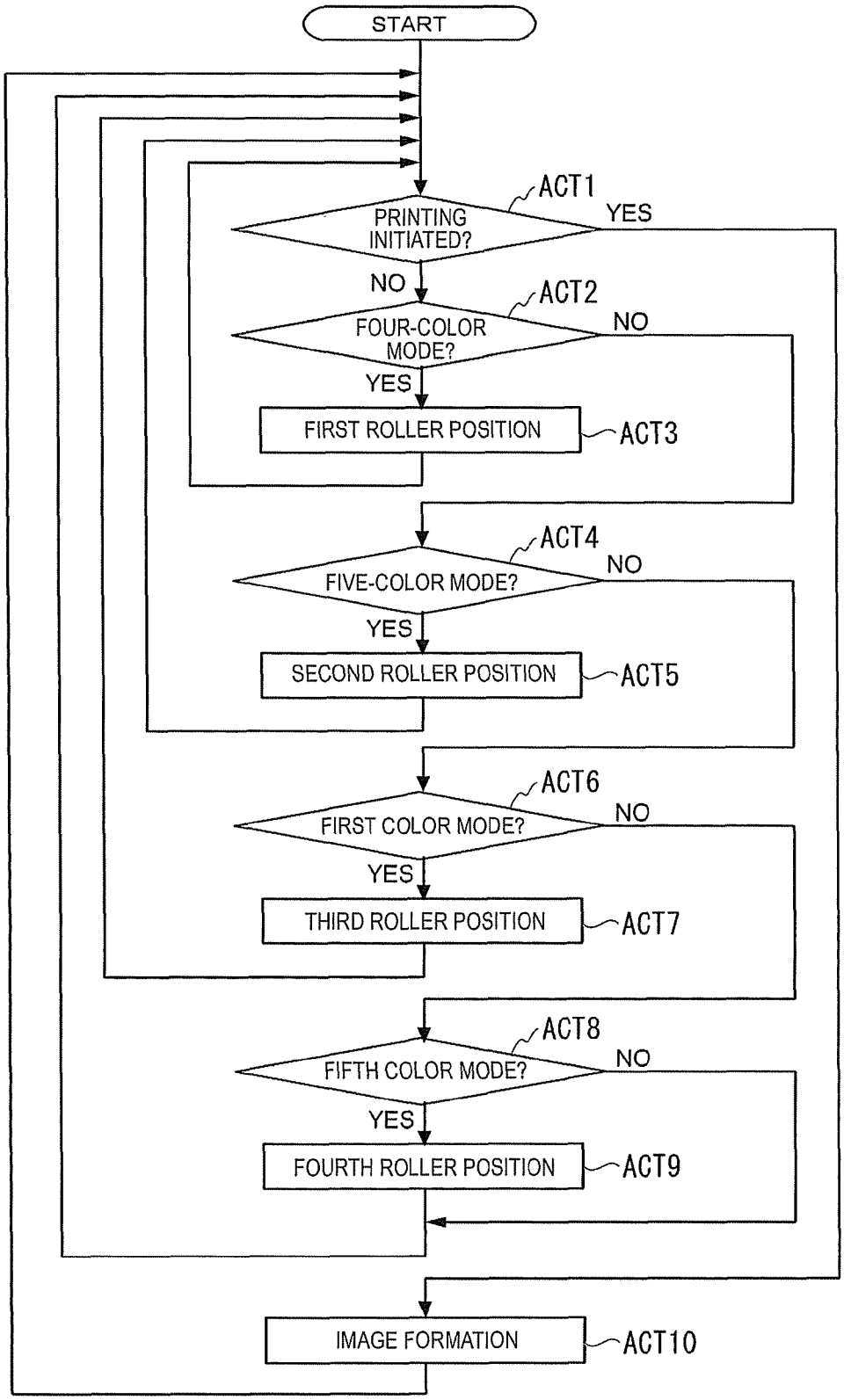
FIG. 7 is a flowchart illustrating the operation of the image forming apparatus in the embodiment.

FIG. 7 is a flowchart illustrating the operation of the image forming apparatus 100 in the embodiment.

The image forming apparatus 100 realizes the belt abutting state according to the operational mode after the operational mode is set.

The operational mode can be set by the operator operating the control panel 1. The control panel 1 transmits a control signal that specifies the operational mode (hereinafter, referred to as an operational mode specifying signal) to the control unit 6 on the basis of the operational input. The operational mode can also be set by the printer interface 201 transmitting the operational mode specifying signal to the control unit 6.

The assumption is made that a signal initiating printing (hereinafter, referred to as a printing initiation signal) occurs with the operational mode not set. In this case, the control unit 6 initiates operation on the basis of a default operational mode. The default operational mode of the image forming apparatus 100 for the belt abutting state is the four-color mode. The image forming apparatus 100 sets the belt abutting state to the first state of abutting after warming up.

The printing initiation signal occurs when the operator operates the start key of the control panel 1. Alternatively, the printing initiation signal may be transmitted to the control unit 6 through the printer interface 201.

The image forming apparatus 100 is assumed to finish warming up. The control unit 6 waits for an interruption. Hereinafter, simply, the occurrence of the printing initiation signal or the operational mode specifying signal will be regarded as an interruption.

The control unit 6 controls the image forming apparatus 100 on the basis of the flow illustrated in FIG. 7.

In ACT 1, the control unit 6 determines whether the printing initiation signal occurs.

ACT 10 is performed when the control unit 6 determines that the printing initiation signal occurs (YES in ACT 1).

ACT 2 is performed when the control unit 6 determines that the printing initiation signal does not occur (NO in ACT 1).

In ACT 2, the control unit 6 determines whether the operational mode specifying signal for the four-color mode occurs.

ACT 3 is performed when the control unit 6 determines that the operational mode, specifying signal for the four-color mode occurs (YES in ACT 2).

ACT 4 is performed when the control unit 6 determines that the operational mode specifying signal for the four-color mode does not occur (NO in ACT 2).

In ACT 3, the control unit 6 causes the abutting switch roller moving unit 36 to move the position of the abutting switch roller 34 to a first roller position Q1 (refer to FIG. 2). The first roller position Q1 is a position that sets the belt abutting state to the first state of abutting. The first roller position Q1 is stored in advance on the storage unit of the control unit 6.

The second tensioned area 27*a* is parallel to the plane A in the first roller position Q1. Thus, the intermediate transfer belt 27 abuts the photoconductive drums 41*y*, 41*m*, 41*c*, and 41*k* in the first roller position Q1 (refer to the positions P4, P3, P2, and P1). At this time, the primary transfer rollers 42*y*, 42*m*, 42*c*, and 42*k* are pressed from the transfer roller pressing units 43*y*, 43*m*, 43*c*, and 43*k* and abut the inner peripheral face of the second tensioned area 27*a*. The second tensioned area 27*a* is interposed between the primary transfer rollers 42*y*, 42*m*, 42*c*, and 42*k* and the photoconductive drums 41*y*, 41*m*, 41*c*, and 41*k*.

Furthermore, in the first roller position Q1, the third tensioned area 27*b* is separated from the photoconductive drum 41*s*. At this time, the primary transfer roller 42*s* abuts the inner peripheral face of the third tensioned area 27*b*. However, the pressure of the transfer roller pressing unit 43*s* is not great enough to press the third tensioned area 27*b* to the photoconductive drum 41*s*.

ACT 3 ends, and ACT 1 is performed after ACT 3.

In ACT 4, the control unit 6 determines whether the operational mode specifying signal for the five-color mode occurs.

ACT 5 is performed when the control unit 6 determines that the operational mode specifying signal for the five-color mode occurs (YES in ACT 4).

ACT 6 is performed when the control unit 6 determines that the operational mode specifying signal for the five-color mode does not occur (NO in ACT 4).

In ACT 5, the control unit 6 causes the abutting switch roller moving unit 36 to move the position of the abutting switch roller 34 to a second roller position Q2 (refer to FIG. 4). The second roller position Q2 is a position that sets the belt abutting state to the second state of abutting. The second roller position Q2 is stored in advance on the storage unit of the control unit 6.

The second tensioned area 27*a*, as in the first roller position Q1, is parallel to the plane A in the second roller position Q2. The second tensioned area 27*a*, as in the first roller position Q1, is interposed between the primary transfer rollers 42*y*, 42*m*, 42*c*, and 42*k* and the photoconductive drums 41*y*, 41*m*, 41*c*, and 41*k*.

Furthermore, in the second roller position Q2, the third tensioned area 27*b* abuts the photoconductive drum 41*s* (refer to the position P5). At this time, the primary transfer roller 42*s* is pressed from the transfer roller pressing unit 43*s* and abuts the inner peripheral face of the third tensioned area 27*b*. The third tensioned area 27*b* is interposed between the primary transfer roller 42*s* and the photoconductive drum 41*s*.

The abutting switch roller 34 is assumed to be moved from the first roller position Q1 to the second roller position Q2. In this case, the abutting switch roller moving unit 36 may move the abutting switch roller 34 in a parallel manner in a direction along the plane A by a certain distance toward the photoconductive drum 41*s*.

The second roller position Q2 is a position to which the first roller position Q1 is moved in a parallel manner in a direction along the plane A by a certain distance toward the photoconductive drum 41*s*.

ACT 5 ends, and ACT 1 is performed after ACT 5.

In ACT 6, the control unit 6 determines whether the operational mode specifying signal for the first color mode occurs.

ACT 7 is performed when the control unit 6 determines that the operational mode specifying signal for the first color mode occurs (YES in ACT 6).

ACT 8 is performed when the control unit 6 determines that the operational mode specifying signal for the first color mode does not occur (NO in ACT 6).

In ACT 7, the control unit 6 causes the abutting switch roller moving unit 36 to move the position of the abutting switch roller 34 to a third roller position Q3 (refer to FIG. 5). The third roller position Q3 is a position that sets the belt abutting state to the third state of abutting. The third roller position Q3 is stored in advance on the storage unit of the control unit 6.

In the third roller position Q3, the second tensioned area 27*a* abuts only the photoconductive drum 41*k* (refer to the position P1). Furthermore, in the third roller position Q3, the third tensioned area 27*b* is separated from the photoconductive drum 41*s*.

The abutting switch roller 34 is assumed to be moved from the first roller position Q1 to the third roller position Q3. In this case, the abutting switch roller moving unit 36 increases the distance between the abutting switch roller 34 and the plane A. The abutting switch roller moving unit 36 causes the intermediate transfer belt 27 tensioned between the passive roller 37 and the abutting switch roller 34 to be inclined upward with the passive roller 37 as the center.

The third roller position Q3 is a position to which the first roller position Q1 is moved in a parallel manner in a direction that is orthogonal with respect to the plane A by a certain distance.

In the third roller position Q3, the intermediate transfer belt 27 abuts only the photoconductive drum 41*k* of the photoconductive drums. The second tensioned area 27*a* is interposed between the primary transfer roller 42*k* and the photoconductive drum 41*k*.

ACT 7 ends, and ACT 1 is performed after ACT 7.

In ACT 8, the control unit 6 determines whether the operational mode specifying signal for the fifth color mode occurs.

ACT 9 is performed when the control unit 6 determines that the operational mode specifying signal for the fifth color mode occurs (YES in ACT 8).

ACT 1 is performed when the control unit 6 determines that the operational mode specifying signal for the fifth color mode does not occur (NO in ACT 8).

In ACT 9, the control unit 6 causes the abutting switch roller moving unit 36 to move the abutting switch roller 34 to a fourth roller position Q4 (refer to FIG. 6). The fourth roller position Q4 is a position that sets the belt abutting state to the fourth state of abutting. The fourth roller position Q4 is stored in advance on the storage unit of the control unit 6.

In the fourth roller position Q4, the second tensioned area 27*a* is separated from the photoconductive drums 41*y*, 41*m*, 41*c*, and 41*k*. Furthermore, in the fourth roller position Q4, the third tensioned area 27*b* abuts the photoconductive drum 41*s* (refer to the position P5).

The abutting switch roller 34 is assumed to be moved from the first roller position Q1 to the fourth roller position Q4. In this case, the abutting switch roller moving unit 36 moves the abutting switch roller 34 in a direction along the plane A slightly closer to the photoconductive drum 41*s* than the second position Q2. The abutting switch roller moving unit 36 further increases the distance between the abutting switch roller 34 and the plane A in a direction that is orthogonal with respect to the plane A than in the third roller position Q3.

The fourth roller position Q4 is a position to which the first roller position Q1 is moved further toward the photoconductive drum 41*s* than the second roller position Q2 and further upward than the third roller position Q3.

In the fourth roller position Q4, the intermediate transfer belt 27 abuts only the photoconductive drum 41*s* of the photoconductive drums. The third tensioned area 27*b* is interposed between the primary transfer roller 42*s* and the photoconductive drum 41*s*.

ACT 9 ends, and ACT 1 is performed after ACT 9.

In ACT 10, the image forming apparatus 100 initiates image formation.

The image forming operation of the image forming apparatus 100 differs depending on the operational mode.

In the four-color mode, the image forming unit 40S does not perform the image forming operation. The light exposure unit 26 stops emitting the exposure light ray L0.

In the five-color mode, all of the image forming units 40S, 40Y, 40M, 40C, and 40K perform the image forming operation. The light exposure unit 26 modulates all of the exposure light rays L0, L1, L2, L3, and L4 according to the image signal.

In the first color mode, only the image forming unit 40K performs the image forming operation. The light exposure unit 26 stops emitting exposure light rays other than the exposure light ray L1.

In the fifth color mode, only the image forming unit 40S performs the image forming operation. The light exposure unit 26 stops emitting exposure light rays other than the exposure light ray L0.

Hereinafter, the image forming operation will be described, excluding the above differences unless otherwise specified. The parts or the members of the apparatus performing the image forming operation will be illustrated by changing the last character of the reference sign thereof to X or x. For example, an image forming unit 40X (photoconductive drum 41*x*) indicates the image forming units 40Y, 40M, 40C, and 40K (photoconductive drums 41*y*, 41*m*, 41*c*, and 41*k*) in the four-color mode. For example, the image forming unit 40X (photoconductive drum 41*x*) indicates the image forming unit 40K (photoconductive drum 41*k*) in the first color mode.

In ACT 10, the control unit 6 causes the printer unit 3 to initiate image formation. The printer unit 3 feeds the appropriate size sheet S from the sheet feeding unit 4 to the resist roller 24.

The control unit 6 charges the photoconductive drum 41*x* of the image forming unit 40X. The control unit 6 forms an electrostatic latent image with the light exposure unit 26 on the photoconductive drum 41*x*.

The control unit 6 causes the developing device of the image forming unit 40X to develop the electrostatic latent image formed on the photoconductive drum 41*x*. A toner image corresponding to the electrostatic latent image is formed on the surface of the photoconductive drum 41*x*.

The control unit 6 causes the intermediate transfer belt drive unit 39 to rotate the intermediate transfer belt 27 in a certain direction. The intermediate transfer belt 27 rotates in synchronization with the rotation of the photoconductive drum 41*x*.

The control unit 6 applies a transfer bias to a primary transfer roller 42*x* and primarily transfers the toner image on the photoconductive drum 41*x* onto the intermediate transfer belt 27. When the image forming unit 40X operating at this time includes multiple image forming units, the transfer timing is appropriately shifted depending on the position of arrangement of each image forming unit of the image forming unit 40X. Thus, each toner image is sequentially overlaid without causing variations in color along with the movement of the intermediate transfer belt 27.

The toner image on the intermediate transfer belt 27 is carried to the transfer unit 28. The sheet S moves to the secondary transfer position at the timing when the tip end of the toner image moves to the secondary transfer position.

The control unit 6 applies a transfer bias to the secondary transfer roller 28*b*. The secondary transfer roller 28*b* secondarily transfers the toner image at the secondary transfer position onto the sheet S. The secondarily transferred toner image is fixed to the sheet S by the fixer 29. The sheet S on which the toner image is fixed is discharged outside the image forming apparatus 100.

Remaining toner that is not transferred by the transfer unit 28 onto the sheet S is scraped by the transfer belt cleaning unit 31. The intermediate transfer belt 27 is cleaned so as to be usable again.

Image formation on one sheet S is ended.

The image forming apparatus 100 includes the image forming units 40S, 40Y, 40M, 40C, and 40K that can form toner images in five colors. In the image forming apparatus 100, the image forming units 40S, 40Y, 40M, 40C, and 40K can print images in each color and in a combined color of each on the sheet S.

The image forming apparatus 100 separates an image forming unit that does not perform image formation from the intermediate transfer belt 27 in the four-color mode, the first color mode, and the fifth color mode. Thus, wear due to contact between the intermediate transfer belt 27 and the photoconductive drum of the image forming unit that does not perform image formation can be reduced. Furthermore, since the photoconductive drum of the image forming unit that does not perform image formation does not abut the intermediate transfer belt 27, an aberration of the primarily transferred toner image due to abutting of the photoconductive drum can be prevented.

The image forming apparatus 100 can switch the belt abutting state among the first, the second, the third, and the fourth states of abutting. At this time, the image forming apparatus 100 changes only the position of the abutting switch roller 34 with the abutting switch roller moving unit 36. Thus, the apparatus configuration of the image forming apparatus 100 can be simplified.

For example, a configuration of causing five photoconductive drums to abut the tensioned intermediate transfer belt 27 by using two rollers is considered when image formation is performed in five colors. In this case, the operational mode can be switched between the five-color mode and the first color (fifth color) mode when the belt abutting state is changed by moving one of the two rollers. In this configuration, unlike in the four-color mode of the image forming apparatus 100, a full color image cannot be formed by separating the photoconductive drum for the fifth color from the intermediate transfer belt. The frequency of use of the fifth color is low in comparison with the four-color full color mode. Thus, degradation of the fifth color image forming unit is comparatively fast despite of the low frequency of use.

Changing the belt abutting state by moving both of the two rollers is also considered. In this case, the belt abutting state can be switched among the five-color mode, the first color mode, and the fifth color mode. However, the four-color mode of the image forming apparatus 100 cannot be realized in this configuration. In addition, since this configuration requires two moving mechanisms, the apparatus configuration is complicated in comparison with the image forming apparatus 100. The number of components is also increased in comparison with the image forming apparatus 100.

In the image forming apparatus 100, the photoconductive drums 41*y*, 41*m*, 41*c*, and 41*k* are arranged on the plane A, and the photoconductive drum 41*s* is arranged to be shifted from the plane A. The abutting switch roller moving unit 36 moves the abutting switch roller 34 between the photoconductive drum 41*y* and the photoconductive drum 41*s*. The abutting switch roller 34 changes the tensioned shape of the intermediate transfer belt 27 between the transfer belt roller 32 and the passive roller 37.

According to the configuration, the image forming apparatus 100 can selectively switch the belt abutting state among the first, the second, the third, and the fourth states of abutting by moving only the abutting switch roller 34. Thus, the image forming apparatus 100 can switch among the four-color mode, the five-color mode, the first color mode, and the fifth color mode with a simple and cheap configuration. Since the fifth color having a low frequency of use is used in image formation when necessary in the image forming apparatus 100, the life of the image forming unit 40S can be prolonged.

Furthermore, since the image forming apparatus 100 includes the first color mode, the life of the second color to the fifth color photoconductive drums having relatively low frequencies of use can be prolonged when the frequency of use of monochrome printing is high.

Hereinafter, modification examples of the above embodiment will be described. The image forming apparatus 100 includes the five-color mode in the description of the above embodiment. However, the image forming apparatus 100 may not include the five-color mode. For example, the five-color mode is not necessary when the fifth color toner is an erasable toner that is erased by heating at a lower temperature than the temperatures for fixing the first color to the fourth color.

The first color is described as black and the fifth color as a gold toner and the like in the description of the above embodiment. However, these are merely examples. Colors to assign to the first color to the fifth color can be freely selected.

The image forming apparatus 100 is described as including four photoconductive drums 41*y*, 41*m*, 41*c*, and 41*k* as the first type photoconductive drums in the description of the above embodiment. However, the number of first type photoconductive drums may be two or three or be five or more as long as two or more of first type photoconductive drums are provided.

The photoconductive drums 41*s*, 41*y*, 41*m*, 41*c*, and 41*k* are described as having the same drum radius in the description of the above embodiment. However, the drum radius of each photoconductive drum may not be the same. The photoconductive drums 41*y*, 41*m*, 41*c*, and 41*k* are arranged to have the common tangent plane T to one drum surface when the drum radius of each photoconductive drum is different. In this case, the height of the rotational axis line of the photoconductive drum from the common tangent plane changes depending on the drum radius. The photoconductive drum 41*s* is arranged at a position that is not tangent to the common tangent plane from the same direction as the photoconductive drums 41*y*, 41*m*, 41*c*, and 41*k*.

According to at least one embodiment described above, the image forming apparatus includes the intermediate transfer belt, the multiple first type photoconductive drums, the first type transfer roller, the second type photoconductive drum, the second type transfer roller, the roller, and the roller moving unit. Thus, the image forming apparatus can separate the photoconductive drum of the image forming unit that does not perform image formation from the intermediate transfer belt with a simple configuration.

While certain embodiments have been described these embodiments have been presented by way of example only, and are not intended to limit the scope of the inventions. Indeed, the novel embodiments described herein may be embodied in a variety of other forms: furthermore various omissions, substitutions and changes in the form of the embodiments described herein may be made without departing from the spirit of the inventions. The accompanying claims and there equivalents are intended to cover such forms or modifications as would fall within the scope and spirit of the invention.

What is claimed is:

1. An image forming apparatus comprising:

an intermediate transfer belt that rotates and carries a toner image which is to be primarily transferred, the toner image being secondarily transferred onto a sheet at a secondary transfer position, the intermediate transfer belt being tensioned by multiple inner rollers;

multiple first type photoconductive drums that are arranged to have a common tangent plane to drum surfaces on the outer peripheral side of the intermediate transfer belt;

multiple first type transfer rollers that are arranged at positions which face the multiple first type photoconductive drums on the inner peripheral side of the intermediate transfer belt and transfer toner images which are formed on the multiple first type photoconductive drums onto the intermediate transfer belt;

a second type photoconductive drum that is arranged on the outer peripheral side of the intermediate transfer belt at a position which is farther separated from the secondary transfer position than the multiple first type photoconductive drums and at a position where the drum surface of the second type photoconductive drum is not tangent to the common tangent plane from the same direction as the multiple first type photoconductive drums;

a second type transfer roller that is arranged on the inner peripheral side of the intermediate transfer belt at a position which faces the second type photoconductive drum and transfers a toner image which is formed on the second type photoconductive drum onto the intermediate transfer belt;

a single roller that is arranged on the inner peripheral side of the intermediate transfer belt between the second type transfer roller and one transfer roller of the multiple first type transfer rollers which is the closest to the second type transfer roller, the single roller being different from two inner rollers of the multiple inner rollers, the two inner rollers being most-distant from each other in the multiple inner rollers inside the intermediate transfer belt; and a roller moving unit that is configured to move the single roller in a first direction and a second direction, the first direction being along the common tangent plane, the second direction being orthogonal with respect to the common tangent plane, the roller moving unit changing the state of abutting of the multiple first type photoconductive drums and the second type photoconductive drum on the intermediate transfer belt by pressing and moving the single roller to the inner peripheral face of the intermediate transfer belt.

2. The apparatus according to claim 1, wherein the roller moving unit forms a first state of abutting in which all of the multiple first type photoconductive drums abut the intermediate transfer belt, and the second type photoconductive drum is separated from the intermediate transfer belt.

3. The apparatus according to claim 1, wherein the roller moving unit forms a second state of abutting in which all of the multiple first type photoconductive drums and the second type photoconductive drum abut the intermediate transfer belt.

4. The apparatus according to claim 1, wherein the roller moving unit forms a third state of abutting in which only one first type photoconductive drum of the multiple first type photoconductive drums that is the closest to the secondary transfer position abuts the intermediate transfer belt, and the other first type photoconductive drums of the multiple first type photoconductive drums and the second type photoconductive drum are separated from the intermediate transfer belt.

5. The apparatus according to claim 4, wherein the first type photoconductive drum that is closest to the secondary transfer position forms a toner image with a black toner.

6. The apparatus according to claim 1, wherein the roller moving unit forms a fourth state of abutting in which the second type photoconductive drum abuts the intermediate transfer belt, and all of the multiple first type photoconductive drums are separated from the intermediate transfer belt.

7. The apparatus according to claim 6, wherein the second type photoconductive drum forms a toner image with an erasable toner.

8. The apparatus according to claim 1, wherein the multiple first type photoconductive drums include four photoconductive drums that form toner images in four colors with yellow, magenta, cyan, and black toners, and the second type photoconductive drum forms a toner image with a color toner other than yellow, magenta, cyan, and black.

9. The apparatus according to claim 1, further comprising first and second fixed rollers of which the positions of abutting the intermediate transfer belt are fixed to two positions that interpose the multiple first type transfer rollers and the second type transfer roller on the inner peripheral side of the intermediate transfer belt, wherein the single roller changes the tensioned shape of the intermediate transfer belt that is tensioned between the first and the second fixed rollers.

10. An image forming method comprising:

forming a toner image by selecting a photoconductive drum from multiple first type photoconductive drums that are arranged to have a common tangent plane to drum surfaces on the outer peripheral side of an intermediate transfer belt which is tensioned by multiple inner rollers and a second type photoconductive drum that is arranged on the outer peripheral side of the intermediate transfer belt at a position which is farther separated from a secondary transfer position than the multiple first type photoconductive drums and at a position where the drum surface of the second type photoconductive drum is not tangent to the common tangent plane from the same direction as the multiple first type photoconductive drums;

changing the tensioned shape of the intermediate transfer belt with a single roller, the single roller being movable in a first direction and a second direction, the first direction being along the common tangent plane, the second direction being orthogonal with respect to the common tangent plane, the single roller abutting the inner peripheral face of the intermediate transfer belt, the single roller pressing the inner peripheral face toward between one first type photoconductive drum of the multiple first type photoconductive drums which is the closest to the second type photoconductive drum and the second type photoconductive drum and causing a photoconductive drum among the multiple first type photoconductive drums and the second type photoconductive drum that forms a toner image to abut the intermediate transfer belt, the single roller being different from two inner rollers of the multiple inner rollers, the two inner rollers being most-distant from each other in the multiple inner rollers inside the intermediate transfer belt; and transferring primarily a toner image on a photoconductive drum among the multiple first type photoconductive drums and the second type photoconductive drum that abuts the intermediate transfer belt onto the intermediate transfer belt.

* * * * *